US007290611B2

(12) United States Patent
Badalamenti et al.

(10) Patent No.: US 7,290,611 B2
(45) Date of Patent: Nov. 6, 2007

(54) METHODS AND SYSTEMS FOR CEMENTING WELLS THAT LACK SURFACE CASING

(75) Inventors: Anthony M. Badalamenti, Katy, TX (US); Simon Turton, Kingwood, TX (US); Karl W. Blanchard, Cypress, TX (US); Ronald R. Faul, Katy, TX (US); Michael G. Crowder, Orlando, OK (US); Henry E. Rogers, Duncan, OK (US); James E. Griffith, Loco, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 423 days.

(21) Appl. No.: 10/897,249

(22) Filed: Jul. 22, 2004

(65) Prior Publication Data

US 2006/0016600 A1 Jan. 26, 2006

(51) Int. Cl.
*E21B 33/02* (2006.01)

(52) U.S. Cl. ..... 166/285; 166/88.1; 166/90.1; 166/93.1; 166/177.4; 166/379

(58) Field of Classification Search ..... 166/379, 166/90.1, 93.1, 285, 177.4, 88.1, 96.1, 75.14
See application file for complete search history.

(56) References Cited

U.S. PATENT DOCUMENTS 2,223,509 A 12/1940 Brauer
2,230,589 A 2/1941 Driscoll
2,407,010 A 9/1946 Hudson
2,472,466 A 6/1949 Counts et al.
2,647,727 A 8/1953 Edwards ..... 255/28
2,675,082 A 4/1954 Hall ..... 166/22
2,849,213 A 8/1958 Failing (Continued)

FOREIGN PATENT DOCUMENTS

EP 0 419 281 A2 3/1991

(Continued)

OTHER PUBLICATIONS

Foreign Communication from a Related Counter Part Application, Oct. 12, 2005.

(Continued)

*Primary Examiner*—Jennifer H. Gay
*Assistant Examiner*—Robert Fuller
(74) *Attorney, Agent, or Firm*—John W. Wustenberg; Baker Botts, L.L.P.

(57) ABSTRACT

Methods and systems for cementing casing in well bores drilled in subterranean formations, and more particularly, methods and systems for cementing casing in a well bore without surface casing or a well head are provided. A method provided herein may comprise sealing an annulus at the mouth of the well bore with a seal; pumping a cement composition into the annulus through the seal; and taking circulation fluid returns from the inner diameter of the casing. A system provided herein may comprise a seal of an annulus at the mouth of the well bore; a cement composition pump fluidly connected to the annulus through the seal; and a coupling connected to the exposed end of the casing for taking circulation fluid returns from the inner diameter of the casing.

29 Claims, 10 Drawing Sheets

U.S. PATENT DOCUMENTS

| | | | | |
|---|---|---|---|---|
| 2,919,709 | A | 1/1960 | Schwegman | 137/68 |
| 3,051,246 | A | 8/1962 | Clark, Jr. et al. | 166/226 |
| 3,193,010 | A | 7/1965 | Bielstien | |
| 3,277,962 | A | 10/1966 | Flickinger et al. | 166/15 |
| 3,948,322 | A | 4/1976 | Baker | 166/289 |
| 3,948,588 | A | 4/1976 | Curington et al. | |
| 3,951,208 | A | 4/1976 | Delano | 166/78 |
| 4,105,069 | A | 8/1978 | Baker | 166/51 |
| 4,271,916 | A | 6/1981 | Williams | |
| 4,300,633 | A | 11/1981 | Stewart | 166/250 |
| RE31,190 | E | 3/1983 | Detroit et al. | 166/293 |
| 4,469,174 | A | 9/1984 | Freeman | 166/202 |
| 4,519,452 | A | 5/1985 | Tsao et al. | |
| 4,531,583 | A | 7/1985 | Revett | 166/253 |
| 4,548,271 | A | 10/1985 | Keller | 166/291 |
| 4,555,269 | A | 11/1985 | Rao et al. | 525/130 |
| 4,671,356 | A | 6/1987 | Barker et al. | 166/285 |
| 4,676,832 | A | 6/1987 | Childs et al. | 106/730 |
| 4,791,988 | A | 12/1988 | Trevillion | 166/285 |
| 4,961,465 | A | 10/1990 | Brandell | 166/184 |
| 5,024,273 | A | 6/1991 | Coone et al. | 166/289 |
| 5,117,910 | A | 6/1992 | Brandell et al. | 166/291 |
| 5,125,455 | A | 6/1992 | Harris et al. | 166/292 |
| 5,133,409 | A | 7/1992 | Bour et al. | 166/293 |
| 5,147,565 | A | 9/1992 | Bour et al. | 252/8.551 |
| 5,188,176 | A | 2/1993 | Carpenter | 166/285 |
| 5,213,161 | A | 5/1993 | King et al. | 166/293 |
| 5,273,112 | A | 12/1993 | Schultz | |
| 5,297,634 | A | 3/1994 | Loughlin | 166/387 |
| 5,318,118 | A | 6/1994 | Duell | 166/202 |
| 5,323,858 | A | 6/1994 | Jones et al. | |
| 5,361,842 | A | 11/1994 | Hale et al. | |
| 5,484,019 | A | 1/1996 | Griffith | 166/293 |
| 5,494,107 | A | 2/1996 | Bode | 166/285 |
| 5,507,345 | A | 4/1996 | Wehunt, Jr. et al. | 166/285 |
| 5,559,086 | A | 9/1996 | Dewprashad et al. | 507/219 |
| 5,571,281 | A | 11/1996 | Allen | |
| 5,577,865 | A | 11/1996 | Manrique et al. | 405/266 |
| 5,641,021 | A | 6/1997 | Murray et al. | |
| 5,647,434 | A | 7/1997 | Sullaway et al. | |
| 5,671,809 | A | 9/1997 | McKinzie | 166/285 |
| 5,718,292 | A | 2/1998 | Heathman et al. | 166/387 |
| 5,738,171 | A | 4/1998 | Szarka | 166/289 |
| 5,749,418 | A | 5/1998 | Mehta et al. | 166/292 |
| 5,762,139 | A | 6/1998 | Sullaway et al. | 166/291 |
| 5,803,168 | A | 9/1998 | Lormand et al. | |
| 5,829,526 | A | 11/1998 | Rogers et al. | |
| 5,875,844 | A | 3/1999 | Chatterji et al. | 166/293 |
| 5,890,538 | A | 4/1999 | Beirut et al. | 166/285 |
| 5,897,699 | A | 4/1999 | Chatterji et al. | 106/678 |
| 5,900,053 | A | 5/1999 | Brothers et al. | 106/678 |
| 5,913,364 | A | 6/1999 | Sweatman | 166/281 |
| 5,968,255 | A | 10/1999 | Mehta et al. | 106/724 |
| 5,972,103 | A | 10/1999 | Mehta et al. | 106/728 |
| 6,060,434 | A | 5/2000 | Sweatman et al. | 507/216 |
| 6,063,738 | A | 5/2000 | Chatterji et al. | 507/269 |
| 6,098,710 | A | 8/2000 | Rhein-Knudsen et al. | 166/285 |
| 6,138,759 | A | 10/2000 | Chatterji et al. | 166/293 |
| 6,143,069 | A | 11/2000 | Brothers et al. | 106/678 |
| 6,167,967 | B1 | 1/2001 | Sweatman | 166/281 |
| 6,196,311 | B1 | 3/2001 | Treece et al. | 166/192 |
| 6,204,214 | B1 | 3/2001 | Singh et al. | 501/155 |
| 6,244,342 | B1 | 6/2001 | Sullaway et al. | 166/285 |
| 6,258,757 | B1 | 7/2001 | Sweatman et al. | 507/219 |
| 6,311,775 | B1 | 11/2001 | Allamon et al. | 166/285 |
| 6,311,792 | B1 * | 11/2001 | Scott et al. | 175/162 |
| 6,318,472 | B1 | 11/2001 | Rogers et al. | |
| 6,367,550 | B1 | 4/2002 | Chatterji et al. | 166/293 |
| 6,431,282 | B1 | 8/2002 | Bosma et al. | |
| 6,454,001 | B1 | 9/2002 | Thompson et al. | 166/250.14 |
| 6,457,524 | B1 | 10/2002 | Roddy | 166/293 |
| 6,467,546 | B2 | 10/2002 | Allamon et al. | 166/381 |
| 6,481,494 | B1 | 11/2002 | Dusterhoft et al. | 166/51 |
| 6,484,804 | B2 | 11/2002 | Allamon et al. | 166/291 |
| 6,488,088 | B1 | 12/2002 | Kohli et al. | 166/285 |
| 6,488,089 | B1 | 12/2002 | Bour et al. | 166/292 |
| 6,488,763 | B2 | 12/2002 | Brothers et al. | 106/692 |
| 6,540,022 | B2 | 4/2003 | Dusterhoft et al. | 166/278 |
| 6,622,798 | B1 | 9/2003 | Rogers et al. | |
| 6,666,266 | B2 | 12/2003 | Starr et al. | |
| 6,732,797 | B1 | 5/2004 | Watters et al. | 166/291 |
| 6,758,281 | B2 | 7/2004 | Sullaway et al. | |
| 6,802,374 | B2 | 10/2004 | Edgar et al. | 166/285 |
| 6,808,024 | B2 | 10/2004 | Schwendemann et al. | |
| 6,810,958 | B2 | 11/2004 | Szarka et al. | |
| 2003/0000704 | A1 | 1/2003 | Reynolds | 166/312 |
| 2003/0029611 | A1 | 2/2003 | Owens | 166/250.03 |
| 2003/0072208 | A1 | 4/2003 | Rondeau et al. | |
| 2003/0192695 | A1 | 10/2003 | Dillenbeck et al. | 166/285 |
| 2004/0079553 | A1 | 4/2004 | Livingstone | 175/61 |
| 2004/0084182 | A1 | 5/2004 | Edgar et al. | 166/285 |
| 2004/0099413 | A1 | 5/2004 | Arceneaux | 166/173 |
| 2004/0104050 | A1 | 6/2004 | Järvelä et al. | 175/57 |
| 2004/0104052 | A1 | 6/2004 | Livingstone | 175/61 |
| 2004/0177962 | A1 | 9/2004 | Bour | 166/285 |
| 2004/0231846 | A1 | 11/2004 | Griffith et al. | |
| 2005/0061546 | A1 | 3/2005 | Hannegan | 175/7 |
| 2006/0016599 | A1 * | 1/2006 | Badalamenti et al. | 166/285 |
| 2006/0016600 | A1 | 1/2006 | Badalamenti et al. | 166/285 |
| 2006/0042798 | A1 | 3/2006 | Badalamenti et al. | 166/285 |
| 2006/0076135 | A1 * | 4/2006 | Rogers et al. | 166/285 |
| 2006/0086499 | A1 | 4/2006 | Badalamenti et al. | 166/250.14 |
| 2006/0086502 | A1 | 4/2006 | Reddy et al. | 166/291 |
| 2006/0086503 | A1 | 4/2006 | Reddy et al. | 166/293 |
| 2006/0131018 | A1 * | 6/2006 | Rogers et al. | 166/285 |

FOREIGN PATENT DOCUMENTS

| | | | |
|---|---|---|---|
| GB | 2193741 | | 2/1988 |
| GB | 2327442 | A | 1/1999 |
| GB | 2348828 | A | 10/2000 |
| RU | 1774986 | | 11/1992 |
| RU | 1778274 | | 11/1992 |
| RU | 1542143 | | 12/1994 |
| RU | 2067158 | | 9/1996 |
| RU | 2 086 752 | C1 | 8/1997 |
| SU | 571584 | | 9/1977 |
| SU | 1420139 | A1 | 8/1988 |
| SU | 1534183 | | 1/1990 |
| SU | 1716096 | A1 | 2/1992 |
| SU | 1723309 | A1 | 3/1992 |
| SU | 1758211 | | 8/1992 |
| WO | WO 2004/104366 | | 12/2004 |
| WO | WO 2005/083229 | A1 | 9/2005 |
| WO | WO 2006/008490 | A1 | 1/2006 |
| WO | WO 2006/064184 | A1 | 6/2006 |

OTHER PUBLICATIONS

Foreign Communication from a Related Counter Part Application, Dec. 7, 2005.

Foreign Communication from a Related Counter Part Application, Sep. 30, 2005.

Foreign Communication from a Related Counter Part Application, Dec. 9, 2005.

Foreign Communication from a Related Counter Part Application, Feb. 24, 2005.

R. Marquaire et al., "Primary Cementing By Reverse Circulation Solves Critical Problem in the North Hassi-Messaoud Field, Algeria", SPE 1111, Feb. 1966.

Foreign Communication from a Related Counter Part Application, Dec. 27, 2005.

Foreign Communication from a Related Counter Part Application, Feb. 23, 2006.

Halliburton brochure entitled "Bentonite (Halliburton Gel)Viscosifier" dated 1999.
Halliburton brochure entitled "Cal-Seal 60 Cement Accelerator" dated 1999.
Halliburton brochure entitled "Diacel D Lightweight Cement Additive" dated 1999.
Halliburton brochure entitled "Cementing Flex-Plug® OBM Lost-Circulation Material" dated 2004.
Halliburton brochure entitled "Cementing FlexPlug® W Lost-Circulation Material" dated 2004.
Halliburton brochure entitled "Gilsonite Lost Circulation Additive" dated 1999.
Halliburton brochure entitled "Micro Fly Ash Cement Component" dated 1999.
Halliburton brochure entitled "Silicalite Cement Additive" dated 1999.
Halliburton brochure entitled "Spherelite Cement Additive" dated 1999.
Halliburton brochure entitled "Increased Integrity with the StrataLock Stabilization System" dated 1998.
Halliburton brochure entitled "Perlite Cement Additive" dated 1999.
Halliburton brochure entitled "The PermSeal System Versatile, Cost-Effective Sealants for Conformance Applications" dated 2002.
Halliburton brochure entitled "Pozmix® A Cement Additive" dated 1999.
Filippov, et al., "Expandable Tubular Solutions," Society of Petroleum Engineers, SPE 56500, Oct. 3-6, 1999.
Daigle, et al., "Expandable Tubulars: Field Examples of Application in Well Construction and Remediation," Society of Petroleum Engineers, SPE 62958, Oct. 1-4, 2000.
Carpenter, et al., "Remediating Sustained Casing Pressure by Forming a Downhole Annular Seal with Low-Melt-Point Eutectic Metal," IADC/SPE 87198, Mar. 2-4, 2004.
Halliburton Casing Sales Manual, Section 4, Cementing Plugs, pp. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
Fryer, "Evaluation of the Effects of Multiples in Seismic Data From the Gulf Using Vertical Seismic Profiles," SPE 25540, 1993.
Griffith, "Monitoring Circulatable Hole with Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al., "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing".
Abstract No. XP-002283586, "Reverse Cemented Casing String Reduce Effect Intermediate Layer Mix Cement Slurry Drill Mud Quality Lower Section Cement Lining".
Brochure, Enventure Global Technology, "Expandable-Tubular Technology," pp. 1-6, 1999.
Dupal, et al., "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094 Apr. 27-30, 2003.
Griffith, et al., Reverse Circulation of Cement on Primary Jobs Increases Cement Column Height Across Weak Formations, Society of Petroleum Engineers, SPE 25440, 315-319, Mar. 22-23, 1993.
Foreign Communication from a Related Counter Part Application, Jan. 8, 2007.
Foriegn Communication from a Related Counter Part Application.

* cited by examiner

METHODS AND SYSTEMS FOR CEMENTING WELLS THAT LACK SURFACE CASING

BACKGROUND OF THE INVENTION

This invention relates to cementing casing in well bores drilled in subterranean formations. In particular, this invention relates to methods for cementing casing in a well bore without surface casing or a well head.

Typically, prior to cement operations, a relatively larger diameter surface casing is run into the well bore to a relatively shallow depth. A casing string is then inserted in a well bore. Circulation fluid fills the inner diameter ("ID") of the casing and the caseing-by-well bore annulus. For purposes of this disclosure, "circulation fluid" is defined as circulation fluid, drilling mud, formation fluids and/or any other fluid typically found in pre-cemented wells. Once the casing is run into the well bore, it is desirable to flow a cement composition into the annulus and allow the cement composition to harden to completely seal the annulus and secure the casing in the bore hole.

However, in some well bores, no surface casing is installed prior to insertion of the casing string. FIG. 1 illustrates a cross-sectional, side view a well bore 1 and casing 3. An annulus 5 is defined between the well bore 1 and the casing 3. At the lower end of the casing, a casing shoe 4 is attached for circulating fluid between the annulus 5 and the inside diameter of the casing 3. The well bore 1 is filled with a circulating fluid such that an annulus circulation fluid surface 6 is at approximately the same depth as an ID circulation fluid surface 10. A reservoir 7 is located proximate to the well bore 1. Also, a truck 9 is parked in the vicinity of the well bore 1. As illustrated, the casing 3 simply protrudes from the mouth of the well bore 1 without a surface casing or a well head. Thus, FIG. 1 simply illustrates an open well bore with casing sticking out of it.

Well configurations as illustrated in FIG. 1 present additional challenges for conducting cementing operations. For example, cementing of these wells is problematic because there is no well head forming a seal of the annulus, there is no well head providing nipple connections for fluid communication with the inner diameter of the casing or the annulus, and there is increased risk of well bore cave-in.

SUMMARY OF THE INVENTION

This invention relates to cementing casing in well bores drilled in subterranean formations. In particular, this invention relates to methods for cementing casing in a well bore without surface casing or a well head.

According to one aspect of the invention, there is provided a method for cementing a casing in an open well bore having no surface casing, wherein an annulus is defined between the casing and the well bore, the method having: sealing the annulus at the mouth of the well bore with a seal; pumping a cement composition into the annulus through the seal; and taking circulation fluid returns from the inner diameter of the casing.

Another aspect of the invention provides a method of sealing a well bore annulus at the mouth of an open well bore having a casing extending there from and no surface casing, the method having: positioning an annular plug around the casing in the annulus below and proximate the mouth of the well bore, wherein the annular plug has conduit through the annular plug allowing fluid communication with the annulus below the annular plug; attaching an anchor to the casing above the annular plug; and pushing the annular plug downwardly away from the anchor.

According to a further aspect of the invention, there is provided a method of sealing a well bore annulus at the mouth of an open well bore having a casing extending there from and no surface casing, the method having: inserting a packer into the annulus below and proximate the mouth of the well bore; expanding the packer in the annulus, wherein the packer has conduit through the packer allowing fluid communication with the annulus below the packer.

A further aspect of the invention provides a method of sealing a well bore annulus at the mouth of an open well bore having a casing extending there from and no surface casing, the method having: plugging the annulus below and proximate the mouth of the well bore with a settable material.

According to still another aspect of the invention, there is provided a method for cementing a casing in an open well bore having no surface casing, wherein an annulus is defined between the casing and the well bore, the method having: injecting a cement composition into the annulus at a level below the mouth of the well bore a sufficient distance to prevent the cement position from flowing out the top of the annulus, whereby the weight of the cement composition in the annulus initiates fluid flow in the well bore in a reverse circulation direction before the cement composition flows out the top of the annulus; and taking circulation fluid returns from the inner diameter of the casing.

Another aspect of the invention provides a system for cementing a casing in an open well bore having no surface casing, wherein an annulus is defined between the casing and the well bore, the system having: a seal of the annulus at the mouth of the well bore; a cement composition pump fluidly connected to the annulus through the seal; and a coupling connected to the exposed end of the casing for taking circulation fluid returns from the inner diameter of the casing.

According to a still further aspect of the invention, there is provided a seal of a well bore annulus at the mouth of an open well bore having a casing extending there from and no surface casing, the seal having: an annular plug around the casing in the annulus below and proximate the mouth of the well bore, wherein the annular plug has conduit through the annular plug allowing fluid communication with the annulus below the annular plug; an anchor attachable to the casing above the annular plug; and at least one jack positioned between the annular plug and the anchor, wherein the at least one jack pushes the annular plug downwardly away from the anchor.

A further aspect of the invention provides a seal of a well bore annulus at the mouth of an well bore having a casing extending there from and no surface casing, the seal having: a packer into the annulus below and proximate the mouth of the well bore, wherein the packer has a conduit through the packer allowing fluid communication with the annulus below the packer.

Another aspect of the invention provides a seal of a well bore annulus at the mouth of an open well bore having a casing extending there from and no surface casing, the seal having: a settable material plug in the annulus below and proximate the mouth of the well bore; and a conduit through the settable material plug.

According to yet another aspect of the invention, there is provided a system for cementing a casing in an open well bore having no surface casing, wherein an annulus is defined between the casing and the well bore, the system having: a cement composition pump; a cement composition injector fluidly connected to the cement composition pump, wherein the injector is positioned at a level below the mouth of the well bore a sufficient distance to prevent the cement composition from flowing out the top of the annulus, whereby the weight of the cement composition in the annulus initiates fluid flow in the well bore in a reverse circulation direction before the cement composition flows out the top of the annulus; and a coupler attached to an exposed end of the casing for taking circulation fluid returns from the inner diameter of the casing.

The objects, features, and advantages of the present invention will be readily apparent to those skilled in the art upon a reading of the description of the preferred embodiments that follows.

BRIEF DESCRIPTION OF THE FIGURES

The present invention is better understood by reading the following description of non-limiting embodiments with reference to the attached drawings wherein like parts of each of the several figures are identified by the same referenced characters, and which and briefly described as follows.

It is to be noted, however, that the appended drawings illustrate only a few aspects of certain embodiments of this invention and are therefore not limiting of its scope, as the invention encompasses equally effective additional or equivalent embodiments.

DETAILED DESCRIPTION OF THE INVENTION

This invention relates to cementing casing in well bores drilled in subterranean formations. In particular, this invention relates to methods for cementing casing in a well bore without surface casing or a well head.

Figure 1:
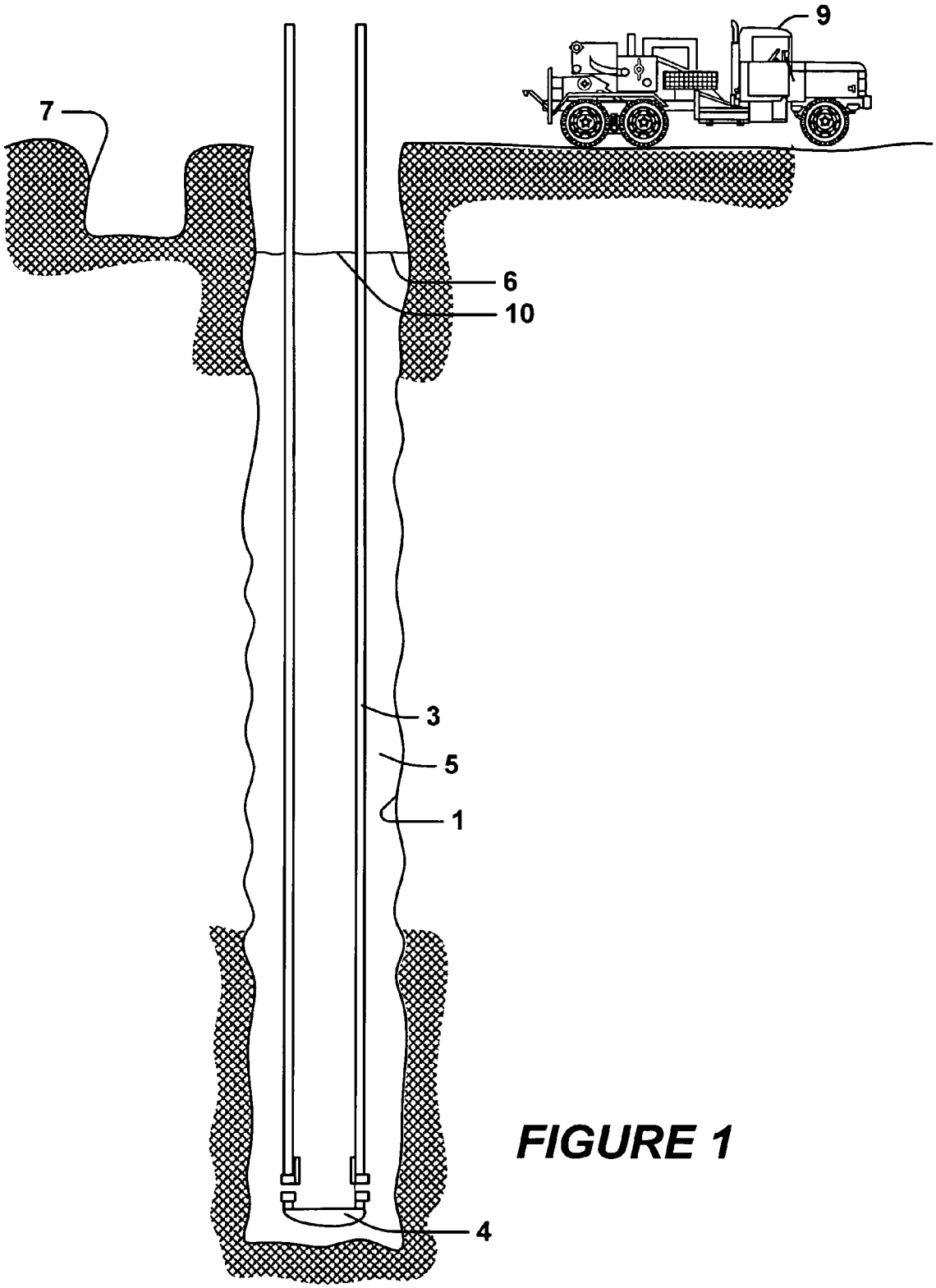
FIG. 1 is a cross-sectional, side view of a well bore and a casing sticking out of the mouth of the well bore above the surface.
Figure 2A:
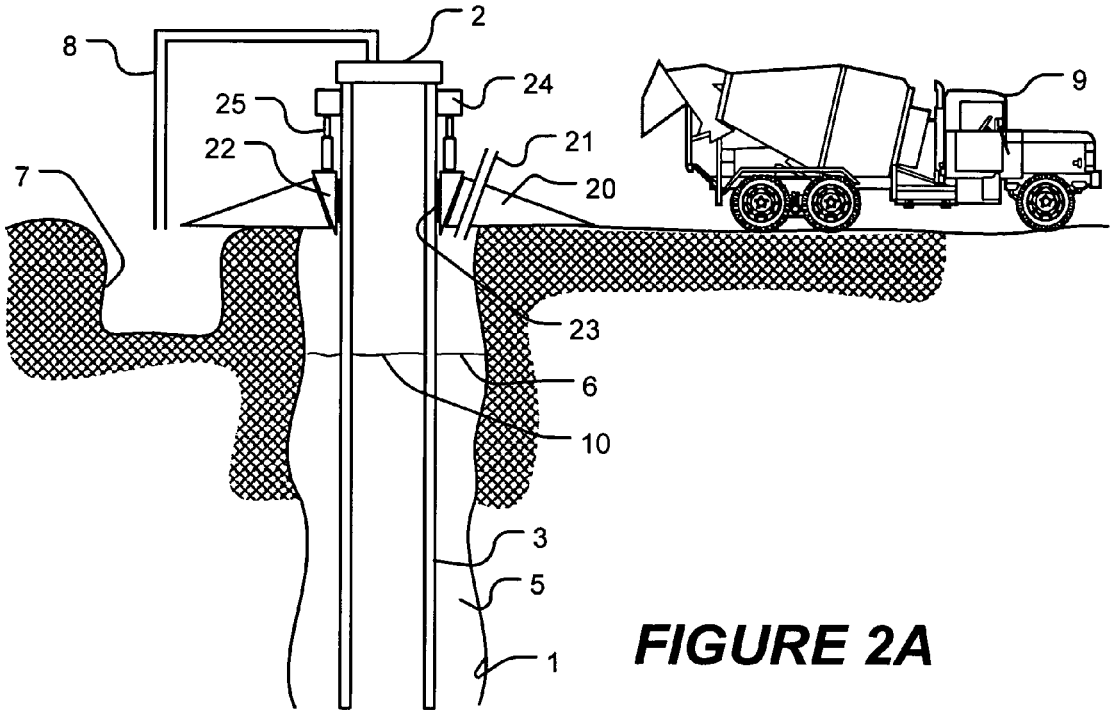
FIG. 2A is a cross-sectional, side view of a well bore and casing wherein an annular plug is attached to the casing at the mouth of the well bore.

FIG. 2A illustrates a cross-sectional, side view of a well bore and casing. Similar to the well bore illustrated in FIG. 1, this well bore has a casing 3 sticking out of the mouth of the well bore 1 without an installed surface casing or well head. An annulus 5 is defined between the casing 3 and the well bore 1. A truck 9 is parked near the well bore and a reservoir is also located nearby. The well bore 1 is also filed with circulation fluid such that an annulus circulation fluid surface 6 is approximately level with an ID circulation fluid surface.

Figure 2B:
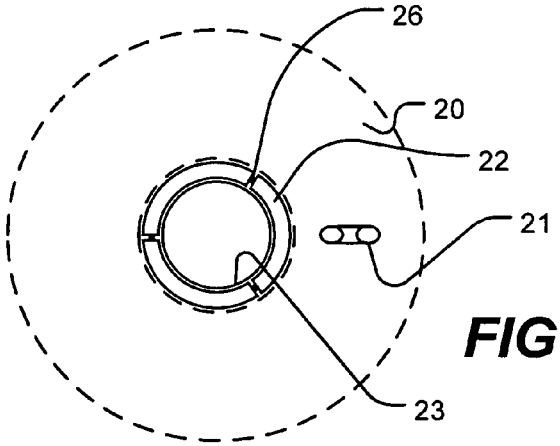
FIG. 2B is a top view of the annular plug shown in FIG. 2A, wherein slips and a seal are positioned within the annular plug.

An annular plug 20 is positioned over the exposed end of the casing 3 and lowered until it rests on the soil at the mouth of the well bore 1. As illustrated, the annular plug is a conical structure with a hole through its center. The inside hole of the annular plug 20 is also a conical shape so as to receive slips 22 between the annular plug 20 and the casing 3. An annular seal 23 is positioned between the casing 3 and the slips 22. FIG. 2B illustrates a top view of the slips 22 and annular seal 23 positioned within the annular plug 20 (shown in dotted lines). Sectional seals 26 are positioned between the slips 22 to seal the gaps between the slips 22.

Referring again to FIG. 2A, a anchor 24 is attached to the casing 3 above the slips 22. Any method known to persons of skill may be used to attach the anchor, such as set screws, welding fastening two halves with bolts, etc. Jacks 25 are positioned between the slips 22 and the anchor 24. Any type of jacks known to persons of skill may be used such as hydraulic, screw, scissor, etc. A single jack or any number of jacks may be used, but in at least only embodiment, it is preferable to distribute the force from the jacks evenly across the slips 22. When the jacks 25 are activated, they anchor themselves against the anchor 24 and push the slips 22 downward into the annular plug 20. Because the inner hole of the annular plug 20 and the slips 22 are conical in shape, the slips wedge themselves between the casing 3 and the annular plug 20 as the downward force generated by the jacks 25 is increased (the annular seal 23 is positioned between the slips 22 and the casing 3). Because the slips 22 and the annular plug 20 are allowed to slide relative to the casing 3, the jacks 25 also press the annular plug 20 firmly against the soil at the mouth of the well bore 1. In this manner, the annular plug 20 completely seals the annulus 5 at the top of the well bore 1.

The annular plug 20 also has a conduit 21 extending through the main conical section. The conduit 21 may have a nipple (not shown) for connecting pipes or hoses. Also, a casing ID coupler 2 is attached to the exposed end of the casing 3 above the annular plug 20. The casing ID coupler 2 may be attached to the exterior or the ID of the casing 3, so long as it seals the open end. It may use dogs or slips to engage the casing. A return line 8 is connected to the casing ID coupler 2 for communicating circulation fluid from the ID of the casing 3 to the reservoir 7.

With the annular plug 20 and casing ID coupler 2 attached to the casing 3, a cementing operation may be conducted on the well bore 1. A pipe or hose (not shown) is connected from the truck 9 to the conduit 21. Premixed cement trucks and pump trucks are illustrated in the various figures of this disclosure. It is to be understood that any type of cement composition and any type of pumping apparatus may be used to pump the cement composition into the annulus. Cement composition is pumped into the annulus 5 through the conduit 21. As the cement composition flows in to the annulus 5, the cement composition contacts the annulus circulation fluid surface 6. Some of the cement composition will free fall in the circulation fluid. To establish fluid flow in a reverse circulation direction, a certain static pressure must be induced to overcome the static gel strength of the circulation fluid in the well bore. Thus, the cement composition is pressurized to drive the circulation fluid downward in the annulus 5. As the circulation fluid flows from the annulus 5 to the casing ID through the casing shoe 4, returns are taken at the casing ID coupler 2 through the return line 8 for deposit in the reservoir 7. The seal of the annulus provided by the annular plug 20 allows for the static fluid pressure to be increased in the annulus. As additional cement composition is pumped into the annulus, the column weight of the cement composition begins to drive fluid flow in the reverse circulation direction so that the static fluid pressure inside the annulus at the annular plug may be reduced. Flow regulators, valves, meters, etc. may also be connected to the annular plug 20, conduit 21, casing 3, casing ID coupler 2, and/or return line 8 to monitor the state of the fluids at various locations in the system.

Figure 3A:
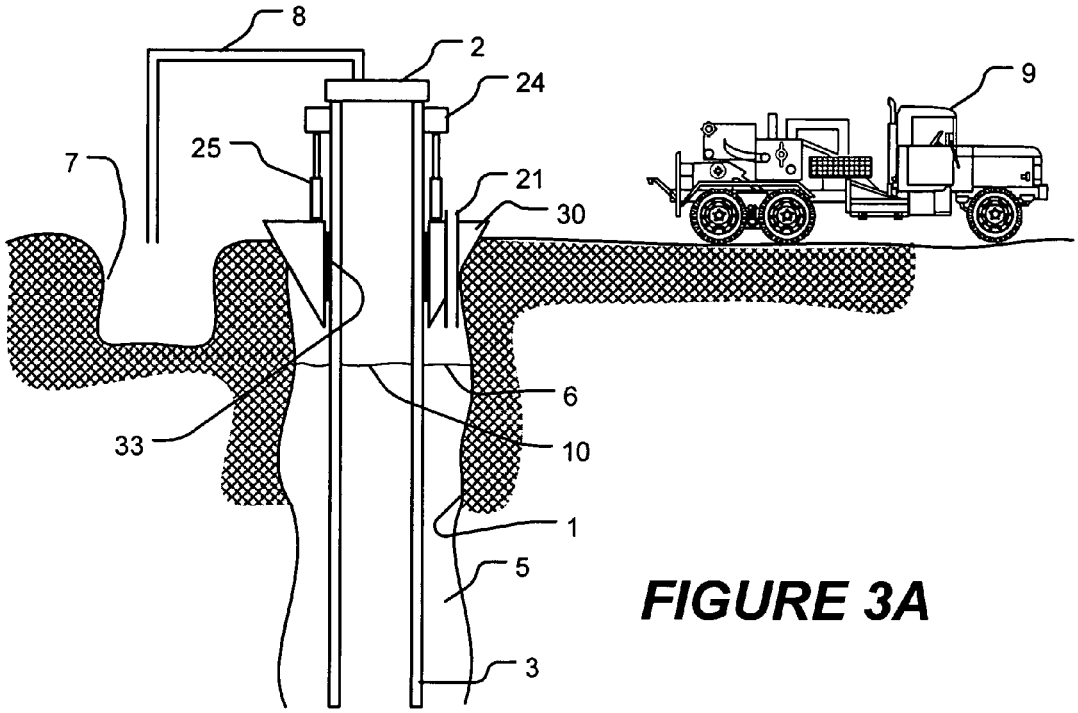
FIG. 3A is a cross-sectional, side view of a well bore and casing wherein a sectional plug is mounted in the annulus at the top of the well bore.

FIG. 3A illustrates a cross-sectional, side view of a well bore and casing. Similar to the well bore illustrated in FIG. 1, this well bore has a casing 3 sticking out of the mouth of the well bore 1 without an installed surface casing or well head. An annulus 5 is defined between the casing 3 and the well bore 1. A truck 9 is parked near the well bore and a reservoir is also located nearby. The well bore 1 is also filed with circulation fluid such that an annulus circulation fluid surface 6 is approximately level with an ID circulation fluid surface.

Figure 3B:
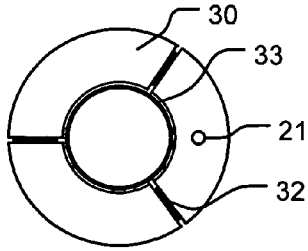
FIG. 3B is a top view of the sectional plug illustrated in FIG. 3A, wherein seals are positioned between the sections of the sectional plug.

In this embodiment, a sectional plug 30 is used to seal the annulus 5 at the top of the well bore 1. FIG. 3B illustrates a top view of the sectional plug shown in FIG. 3A. The sectional plug 30 has three arcuate sections, which together combine to form an annular structure for insertion into the annulus 5. The sectional plug 30 is a conical structure with a hole in the middle in the middle is cylindrical and has a diameter slightly larger than the outside diameter of the casing 3. A cylindrical annular seal 33 is positioned between the sectional plug 30 and the casing 3. While the illustrated embodiment has three arcuate sections forming the sectional plug 30, is should be understood that any number of arcuate sections may be used to form the annular structure.

To seal the annulus 5, the annular seal 33 is fitted around the casing immediately below the mouth of the well bore 1. The sections of the sectional plug 30 are then inserted into the annulus 5 between the annular seal 33 and the mouth of the well bore 1. Sectional seals 32 are positioned between adjacent sections of the sectional plug 30. With the seals and sectional plug in place, a anchor 24 is attached to the casing 3 above the sectional plug 30. Jacks 25 are then positioned between the anchor 24 and the sectional plug 30. As described above, any anchor or jack may be used. When the jacks 25 are extended, the jacks press against the anchor 24 to drive the sectional plug 30 deeper into the annulus 5. Because the sectional plug 30 is a conical shape, the sectional plug become tightly wedged in the annulus 5. As the sectional plug 30 moves deeper in the annulus, the well bore 1 presses the sectional plug 30 toward the casing 3 to shrink fit the sectional plug 30 around the annular seal 33 and squeeze the sectional seals 32.

In alternative embodiments of the invention, the sections of the sectional plug 30 may be coupled together after they are inserted into the mouth of the annulus. Also, a solid annular ring may be positioned between the sectional plug 30 and the jacks 25 so that force applied by the jacks is even distributed to the sectional plug 30.

The sectional plug 30 also has a conduit 21 for communicating fluid to and from the annulus 5. A casing ID coupler 2 is also attached to the casing 3 to seal the ID of the casing 3. A return line 8 is attached to the casing ID coupler 2 for communicating fluids from the ID of the casing 3 to a reservoir 7. With the sectional plug 30 firmly in place in the annulus at the mouth of the well bore 1, cement may be pumped into the annulus 5 through the conduit 21. As illustrated, the annular circulation fluid surface 6 is level with the ID circulation fluid surface 10. When a cement composition is pumped into the annulus 5 through conduit 21, the fluid pressure in the annulus 5 begins to build. The static fluid pressure in the annulus 5 eventually become great enough to overcome the gel strength of the circulation fluid in the well bore 1, so as to initiate fluid flow in the well bore in a reverse circulation direction. As more cement composition is pumped into the annulus, fluid returns are taken from the ID of the casing 3 through the return line 8 for deposit in the reservoir 7. While a certain static fluid pressure overcomes the gel strength of the circulation fluid, the sectional plug 30 provides a sufficient seal at the mouth of the well bore to prevent the cement composition from leaking out the top of the annulus 5. Once fluid flow through the well bore is established, the static fluid pressure in the annulus 5 at the mouth of the well bore may be reduced. As more and more cement composition is pumped into the annulus, the additional weight of the cement composition continues to drive fluid flow in the well bore in the reverse circulation direction.

Figure 4A:
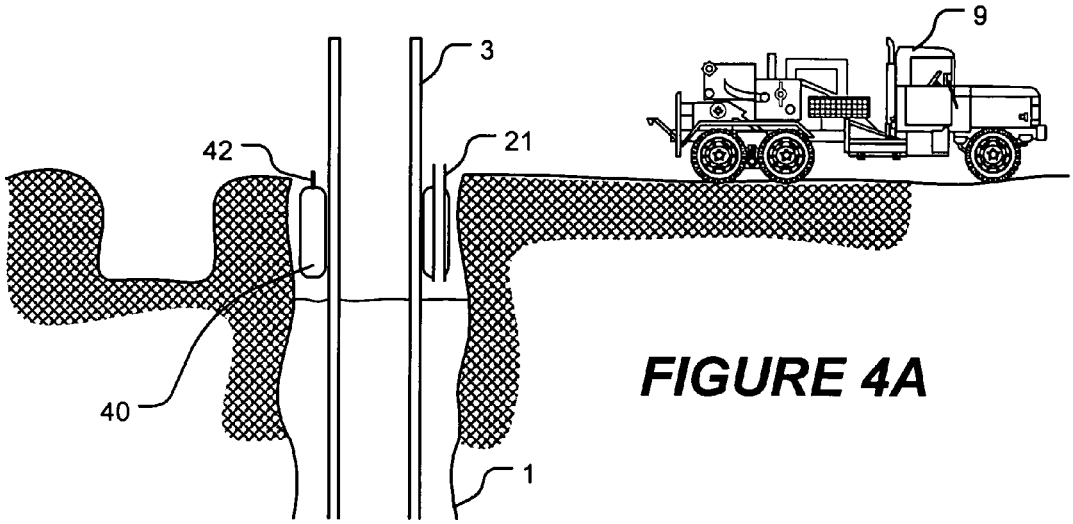
FIG. 4A is a cross-sectional, side view of a well bore and casing, wherein a packer is positioned in the annulus at the mouth of the well bore.
Figure 4C:
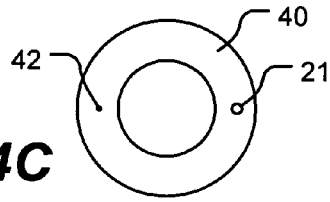
FIG. 4C is a top view of the packer identified in FIGS. 4A and 4B.
Figure 4B:
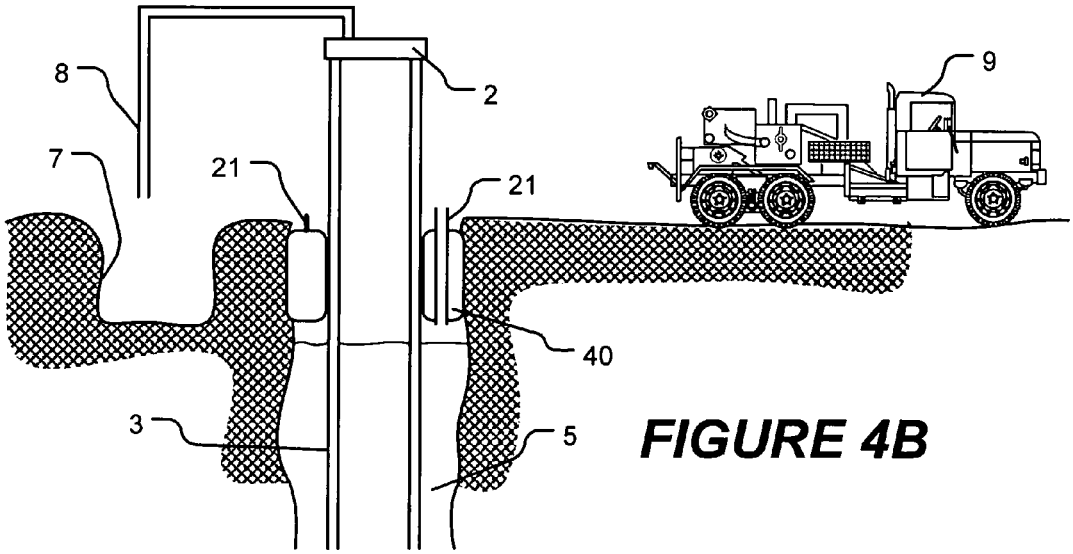
FIG. 4B is a cross-sectional, side view of the well bore and casing illustrated in FIG. 4A, wherein the packer is inflated to seal the annulus at the top of the well bore.

Referring the FIG. 4A, a cross-sectional, side view of a well bore and casing are illustrated. The casing 3 extends from the mouth of the well bore 1. A truck 9 is parked in the vicinity of the well bore 1. In this embodiment of the invention, the mouth of the well bore 1 is sealed by an inflatable packer 40. A top view of the packer 40 is shown in FIG. 4C. The packer 40 is an annular element having an inflation nipple 42 and a conduit 21. The packer 40 is slipped over the top of the casing 3 and pushed down over the casing 3 into the mouth of the well bore 1. When the packer 40 is properly positioned, the inflation nipple 42 is used to inject a fluid or gas into the packer for inflation. FIG. 4B is a cross-sectional, side view of the well bore illustrated in FIG. 4A. In FIG. 4B, the packer 40 is inflated to completely seal the annulus 5 at the mouth of the well bore 1. In particular, the packer 40 expands between the casing 3 and the well bore 1 to form the seal.

When the packer 40 is set in the annulus 5, a casing ID coupler 2 may then be attached to the top of the casing 3. A return line 8 may also be attached to the casing ID coupler 2. When these preparations are completed, a truck 9 or any other pump, container or known device may be used to inject a cement composition or other fluid into the annulus 5 through the conduit 21. The cement composition is pumped into the annulus and returns are taken from the ID of the casing as previously described.

In an alternative embodiment of the invention, a mechanically set packer is used to seal the annulus at the mouth of the well bore. The mechanically set packer is positioned in the annulus and mechanically manipulated to expand an annular packer element between the casing and the well bore. Typical mechanically set packers compress the annular packer element in a longitudinal direction to expand the element radially and outwardly. Most commercial balloon-type packers may be modified for use with the present invention. For example, packers manufactured by Weatherford International called an Annulus Casing Packer and by Halliburton called an External Sleeve Inflatable Packer Collar or a Full Opening Inflatable Packer Collar may be modified to include a conduit. Most commercial mechanical set packers may be modified for use with the present invention. For example, packers manufactured by Halliburton called Cup-Type Casing Packer Shoes may be modified to include a conduit.

Figure 5A:
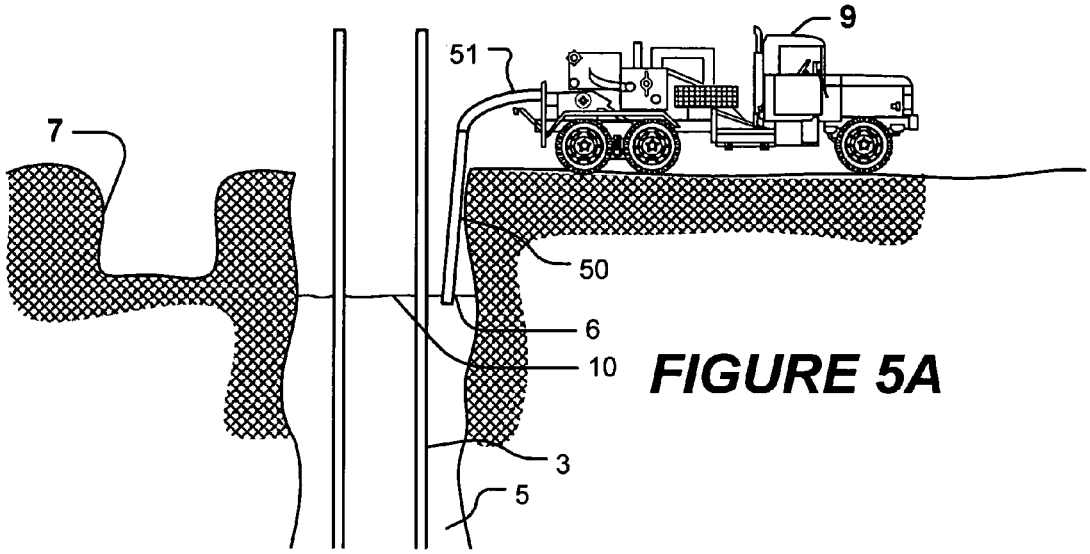
FIG. 5A is a cross-sectional, side view of a well bore and casing wherein a conduit is inserted into the annulus at the top of the well bore and attached to a pump truck.

Referring to FIG. 5A, a cross-sectional side view of a well bore and casing are illustrated. The casing 3 extends from the mouth of the well bore 1 and an annulus 5 is defined between the casing 3 and the well bore 1. A truck 9 is parked in the vicinity of the well bore 1. Also, a reservoir 7 is positioned near the well bore 1. The well bore is also filled with a circulation fluid. In particular, an annular circulation fluid surface 6 is approximately level with an ID circulation fluid surface 10.

In this embodiment of the invention, the mouth of the annulus is sealed by a settable material. A conduit 50 is inserted into the annulus 5 at the mouth of the well bore 1 until its lower end is approximately at the same depth as the annulus circulation fluid surface 6. The conduit 50 is also fluidly connected to a pump truck 9 via a hose 51. When the conduit 50 is properly positioned, a settable material is pumped down the conduit in liquid form and allowed to float on top of the circulation fluid in the annulus 5.

Figure 5B:
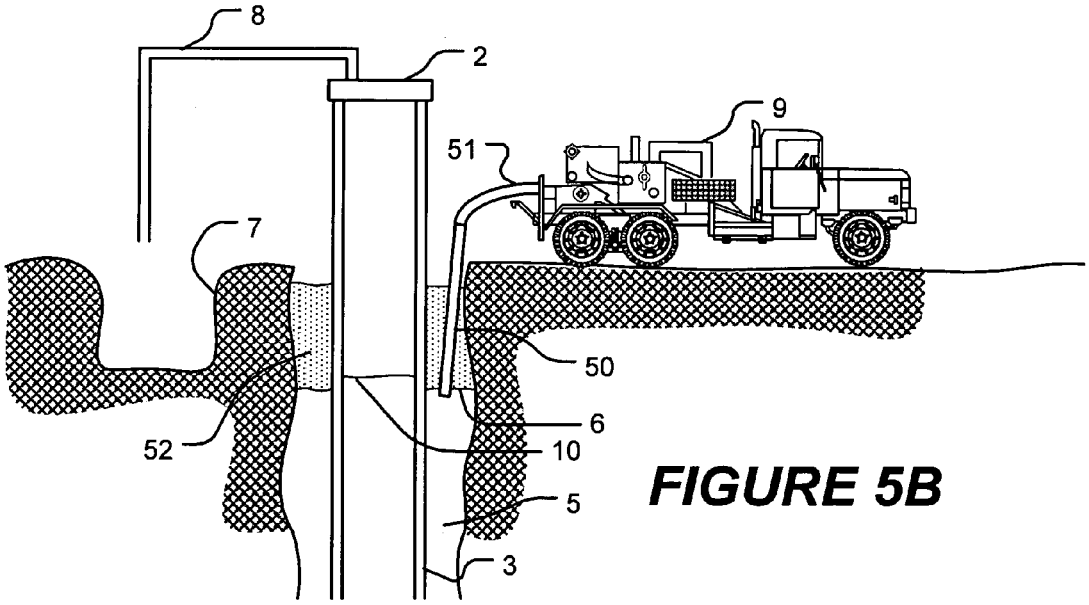
FIG. 5B is a cross-sectional, side view of the well bore and casing illustrated in FIG. 5A, wherein a settable material is pumped into the annulus at the top of the well bore.

Referring to FIG. 5B, a cross-sectional, side view is shown of the well bore and casing of FIG. 5A. In this illustration, the settable material 52 has been pumped down the conduit 50 into the annulus 5 at the mouth of the well bore 1. The settable material 52 is light weight and less dense then the circulation fluid already present in the well bore 1. Thus, the settable material 52 floats on top of the circulation fluid in the annulus. As additional settable material 52 is pumped into the annulus 5, it rises in the annulus 5 toward the mouth of the well bore 1. When a desired amount of settable material 52 is pumped into the annulus 5, a small volume of circulation fluid is pumped behind the settable material to flush the settable material 52 from the conduit 50. The conduit 50 is then closed or otherwise maintained so as to prevent the settable material from flowing back into the conduit 50. The settable material 52 is then allowed to stand in the annulus a sufficient period of time to set or solidify. Once the settable material 52 has hardened, a cement composition or other fluid may be pumped into the annulus 5 through the conduit 50. As the cement composition is pumped into the annulus, the static fluid pressure of the fluid in the annulus 5 begins to build under the seal formed by the settable material 52. Eventually, the static fluid pressure overcomes the gel strength of the circulation fluid in the well bore so as to begin flow in a reverse circulation direction. As additional cement composition is pumped into the annulus 5, the weight of the cement composition maintains the fluid flow through the well bore until a desired amount of cement composition has been pumped into the annulus 5.

The settable material may be any material capable of flowing through the conduit and setting once positioned in the annulus. It is also preferable for the settable material to be less dense than the circulation fluid so that the material will float on top of the circulation fluid in the annulus. Depending on the particular application, a 10 foot column of settable material is sufficient to seal the mouth of the annulus. Also, it may be necessary to adjust the depth of the annulus circulation fluid surface 6 by adding or withdrawing circulation fluid. Because the settable material floats on this surface, the depth of the annulus circulation fluid surface 6 defines the bottom of the plug formed by the settable material. Settable materials that may be used with the present invention include: Cal-Seal of Micro Matrix Cement.

The settable material may be a flash-set composition that is made to flash set with an activator or a flash set composition without the activator. In both cases the activator is mixed with the composition before or as it is injected through conduit 50. Examples of activators which flash set a typical cement slurry include sodium or potassium carbonate and bicarbonate salts, sodium silicate salts, sodium aluminate salts, ferrous and ferric salts such as ferric chloride, ferric sulfate, calcium nitrate, calcium acetate, calcium chloride, calcium nitrite, polyacrylic acid salts and the like. It is preferable that these activators are used in the solid form especially if they form high pH solution when exposed to water. Examples of flash setting cement compositions include high aluminate cements and phosphate cements. In the case of high aluminate cements, typical formulations contain Portland cement, calcium aluminate, calcium sulfate and lime. The calcium aluminate cement may be in the 10% to 50% by weight of total composition 2% to 15% calcium sulfate, 0.5% to 20% and 40% to 80% Portland cement in the total composition. An example of phosphate cement suitable for use as a settable material comprises magnesium oxide and alkali metal phosphate salts. Such compositions are described in U.S. Pat. No. 6,204,214, incorporated herein by reference.

The settable material may also be any light weight cement slurry, including water extended slurries with materials such as bentonite, sodium silicate, pozzalanic materials, fly ash, micro-spheres, perlite, Gilsonite, Diacel, and/or polymers. An example of a suitable light weight cement slurry is commercially available as TXI. Any other light weight cement that is available commercially may also be suitable for use as a settable material. Also, cement foamed with nitrogen, air or another gas may also be suitable for use as a settable material.

The settable material may also be a non cement material such as resins like epoxy, Epseal, Permseal, etc (these may be expensive but a small volume of epoxy resin could replace a larger volume of cement to effect a seal). The settable material may also be a polymer pill that reacts with well bore fluid, such as commercially available polymers named Gunk, Flex Plug, etc.

Figure 6A:
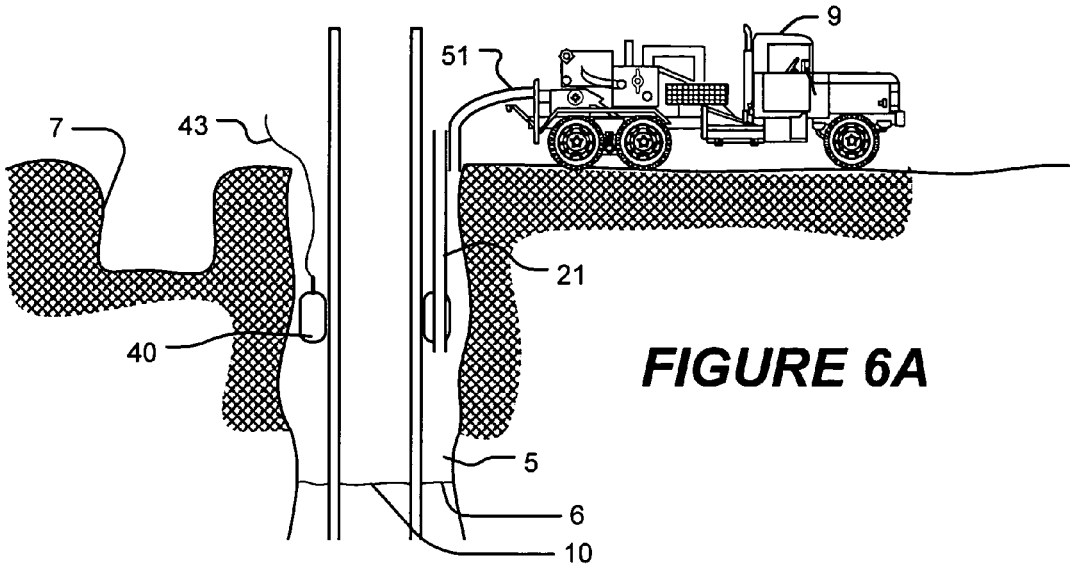
FIG. 6A is a cross-sectional, side view of a well bore and casing wherein a packer and conduit are inserted into the annulus at the top of the well bore.
Figure 6C:
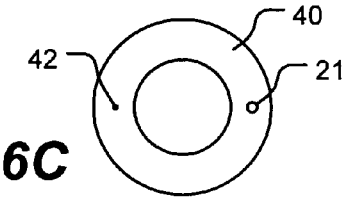
FIG. 6C is a top view of the packer identified in FIGS. 6A and 6B.

Referring the FIG. 6A, a cross-sectional, side view of a well bore and casing are illustrated. The casing 3 extends from the mouth of the well bore 1. A truck 9 is parked in the vicinity of the well bore 1. In this embodiment of the invention, the mouth of the well bore 1 is sealed by a settable material that is placed in the mouth of the annulus at some level above the annulus circulation fluid surface 6. If it is not desirable to raise the annulus circulation fluid surface 6 by injecting additional fluid into the well bore, a packer 40 may be used. A top view of the packer 40 is shown in FIG. 6C. The packer 40 is an annular element having an inflation nipple 42 and a conduit 21. The packer 40 is slipped over the top of the casing 3 and pushed down over the casing 3 into the mouth of the well bore 1. The packer 40 is pushed down into the well bore 1 to a desired location below the mouth of the annulus 5. Depending on the particular application, a depth of fifteen feet is sufficient. The conduit 21 is long enough to extend out of the mouth of the well bore 1. When the packer 40 is properly positioned, the inflation nipple 42 and hose 43 are used to inject a fluid or gas into the packer for inflation.

Figure 6B:
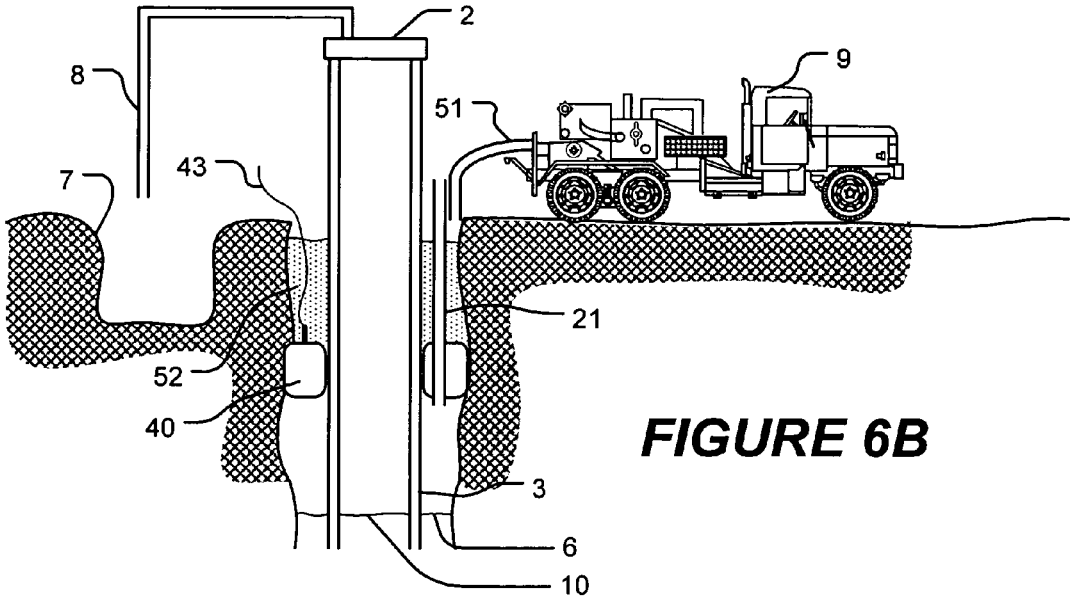
FIG. 6B is a cross-sectional, side view of the well bore and casing illustrated in FIG. 6A, wherein a settable material is pumped into the annulus at the top of the well bore on top of the inflated packer.

FIG. 6B is a cross-sectional, side view of the well bore illustrated in FIG. 6A. In FIG. 6B, the packer 40 is inflated to completely seal the annulus 5 at a position well below the mouth of the well bore 1. In particular, the packer 40 expands between the casing 3 and the well bore 1 to form the seal. With the packer 40 set in the well bore, a settable material 52 is then pumped into the annulus at the surface from the truck 9. The settable material 52 is retained in the annulus 5 above the packer 40. The settable material 52 is allowed to stand in the annulus so as to solidify or harden. In this embodiment of the invention, a more dense settable material 52 may be used as there is no need for the settable material 52 to "float" on top of the circulation fluid.

Figure 7A:
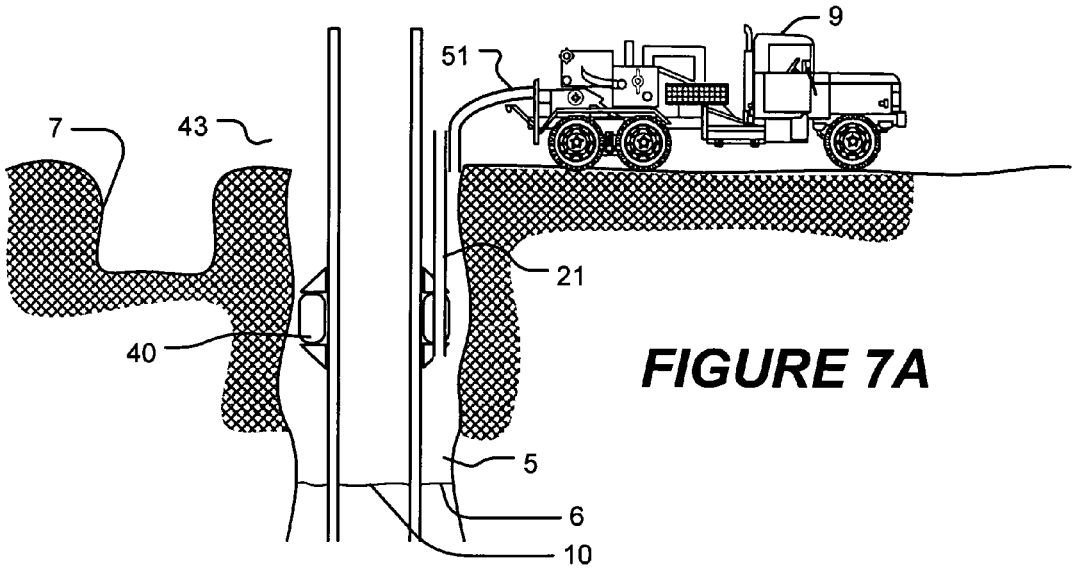
FIG. 7A is a cross-sectional, side view of a well bore and casing wherein a mechanical slip packer and conduit are inserted into the annulus at the top of the well bore.
Figure 7B:
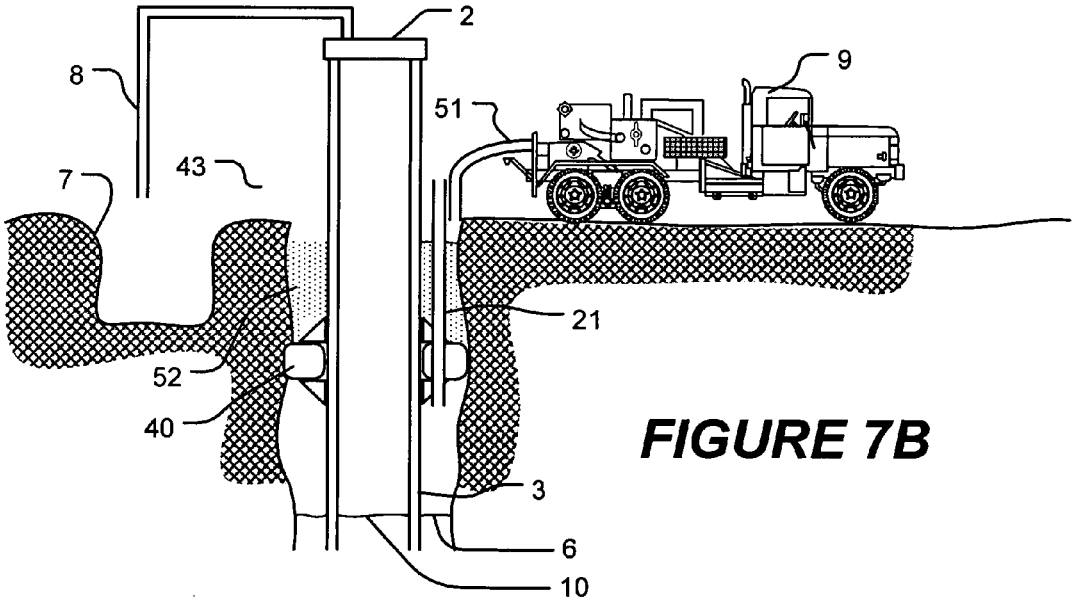
FIG. 7B is a cross-sectional, side view of the well bore and casing illustrated in FIG. 7A, wherein a settable material is pumped into the annulus at the top of the well bore on top of the expanded mechanical slip packer.

FIGS. 7A and 7B illustrate an alternative embodiment of the invention similar to that illustrated in FIGS. 6A through 6C. However, rather than an inflatable packer, a mechanical slip packer is used the mechanical slip packer has a seal member that expands in the radial direction when it is compressed by the slips in the longitudinal direction. Any mechanical set packer known to persons of skill may be used with the invention.

Figure 8A:
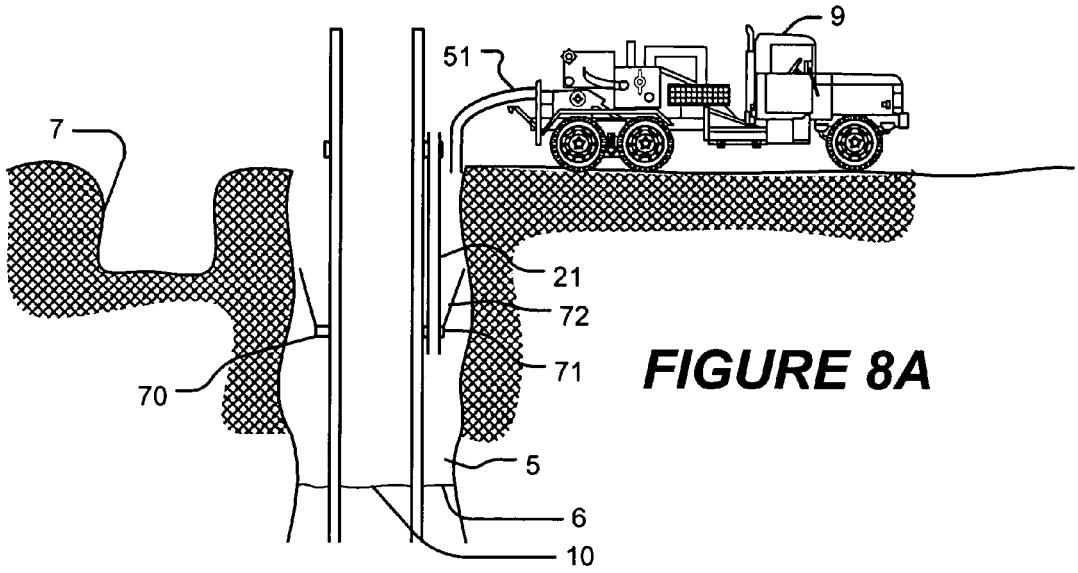
FIG. 8A is a cross-sectional, side view of a well bore and casing wherein a basket and conduit are inserted into the annulus at the top of the well bore.
Figure 8C:
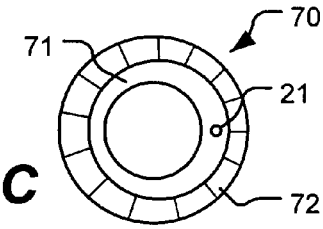
FIG. 8C is a top view of the basket identified in FIGS. 7A and 7B.

FIG. 8A illustrates a cross-sectional, side view of a well bore and casing. The casing 3 extends from the mouth of the well bore 1. A truck 9 is parked in the vicinity of the well bore 1 and a reservoir 7 is located nearby. In this embodiment of the invention, the mouth of the well bore 1 is sealed by a settable material that is placed in the mouth of the annulus above a basket 70. A top view of the basket 70 is shown in FIG. 8C. The basket 70 has an annular band 71 that has an inside diameter slightly larger than the outside diameter of the casing. This enables the band 71 to slide over the top of the casing 3 and be pushed down over the casing 3 into the mouth of the well bore 1. An inverted skirt 72 is attached to the band 71 and a conduit 21 extends through the band 71. The basket 70 is pushed down into the annulus 5 to a desired location below the mouth of the well bore 1. Depending on the particular application, a depth of fifteen feet is sufficient. The conduit 21 is long enough to extend out of the mouth of the well bore 1. Also an anchor 73 is used to attach the top of the conduit 21 to the casing 3 to prevent the basket 70 from sliding any further down in the annulus 5. When the basket 70 is properly positioned and anchored to the casing 3, a settable material may be injected into the annulus 5.

Figure 8B:
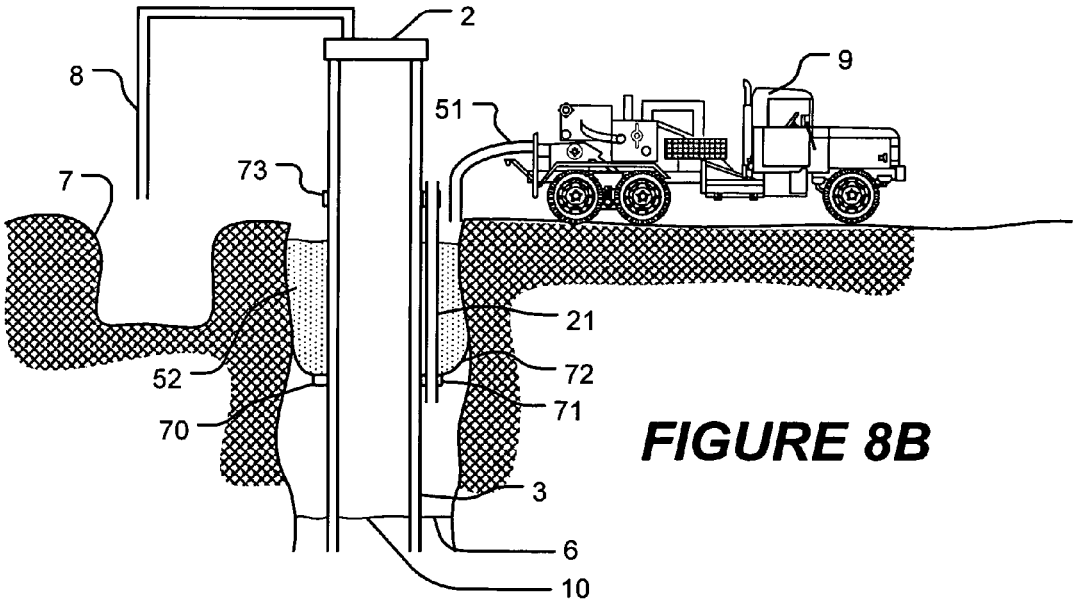
FIG. 8B is a cross-sectional, side view of the well bore and casing illustrated in FIG. 8A, wherein a settable material is pumped into the annulus at the top of the well bore on top of the basket.

FIG. 8B shows a cross-sectional, side view of the well bore illustrated in FIG. 8A. In FIG. 8B, the inverted skirt 72 of the basket 70 has completely flared out in the annulus 5 to catch the falling settable material 52. In particular, the basket 70 expands like an up-side-down umbrella between the casing 3 and the well bore 1 to block the annulus 5. With the basket 70 anchored in the well bore, a settable material 52 is then pumped into the annulus 5 at the surface from the truck 9. The settable material 52 is retained in the annulus 5 above the basket 70. The settable material 52 is allowed to stand in the annulus so as to solidify or harden. In this embodiment of the invention, a more dense settable material 52 may be used as there is no need for the settable material 52 to "float" on top of the circulation fluid. The depth of the annulus circulation fluid surface 6 may be above, level with, or below the depth of the basket 70. No matter whether the basket 70 is submerged in the circulation fluid or not, the basket 70 catches the free falling settable material. Once the settable material has solidified or hardened, cement operations may be conducted through the conduit 21.

Any number of commercially available baskets may be used with the present invention. For example, casing baskets manufactured by Top-co Industries; Industrial Rubber; and Antelope Oil Tool and Manufacturing Co. may be modified to include a conduit.

Figure 9A:
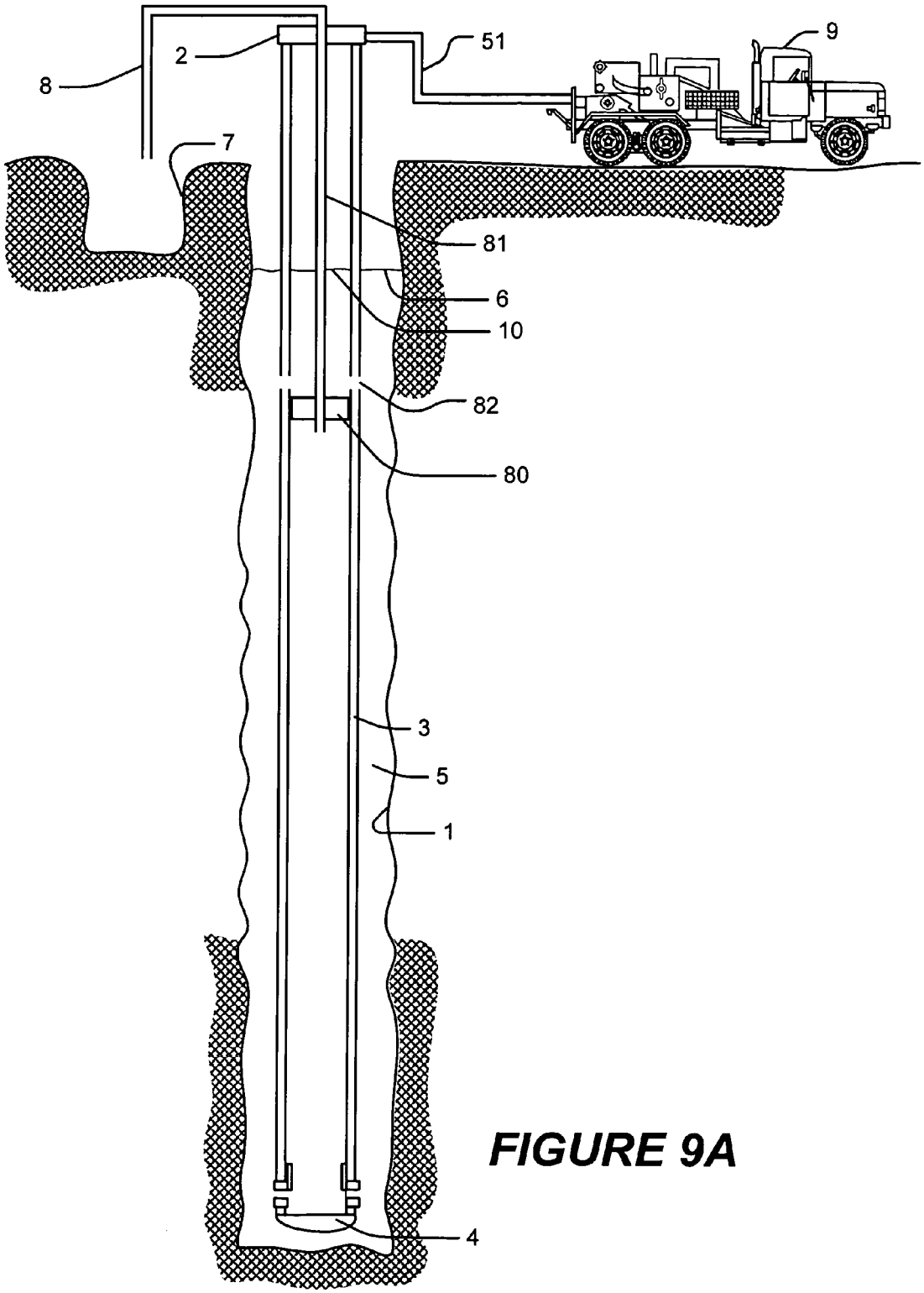
FIG. 9A is a cross-sectional, side view of a well bore and casing wherein a cross-over tool and ID line are positioned in the casing for injecting a cement composition into the annulus at the level below the mouth of the well bore.

FIG. 9A illustrates a cross-sectional, side view of a well bore and casing. The casing 3 extends from the mouth of the well bore 1. A truck 9 is parked in the vicinity of the well bore 1 and a reservoir 7 is located nearby. In this embodiment of the invention, the mouth of the well bore 1 is not sealed at all. Rather, a cement composition is flowed into the annulus at a location below mouth of the well bore. In particular, a cross-over tool 80 is positioned in the ID of the casing a certain distance in the well bore 1. A casing ID coupler 2 is attached to the exposed end of the casing 3. An ID line 81 extends from the casing ID coupler 2 to the cross-over tool 80 for fluid communication with the ID of the casing 3 below the cross-over tool 80. A hose 51 is connected between the truck 9 and the casing ID coupler for fluid communication with the ID of the casing 3 above the cross-over tool 80.

Figure 9B:
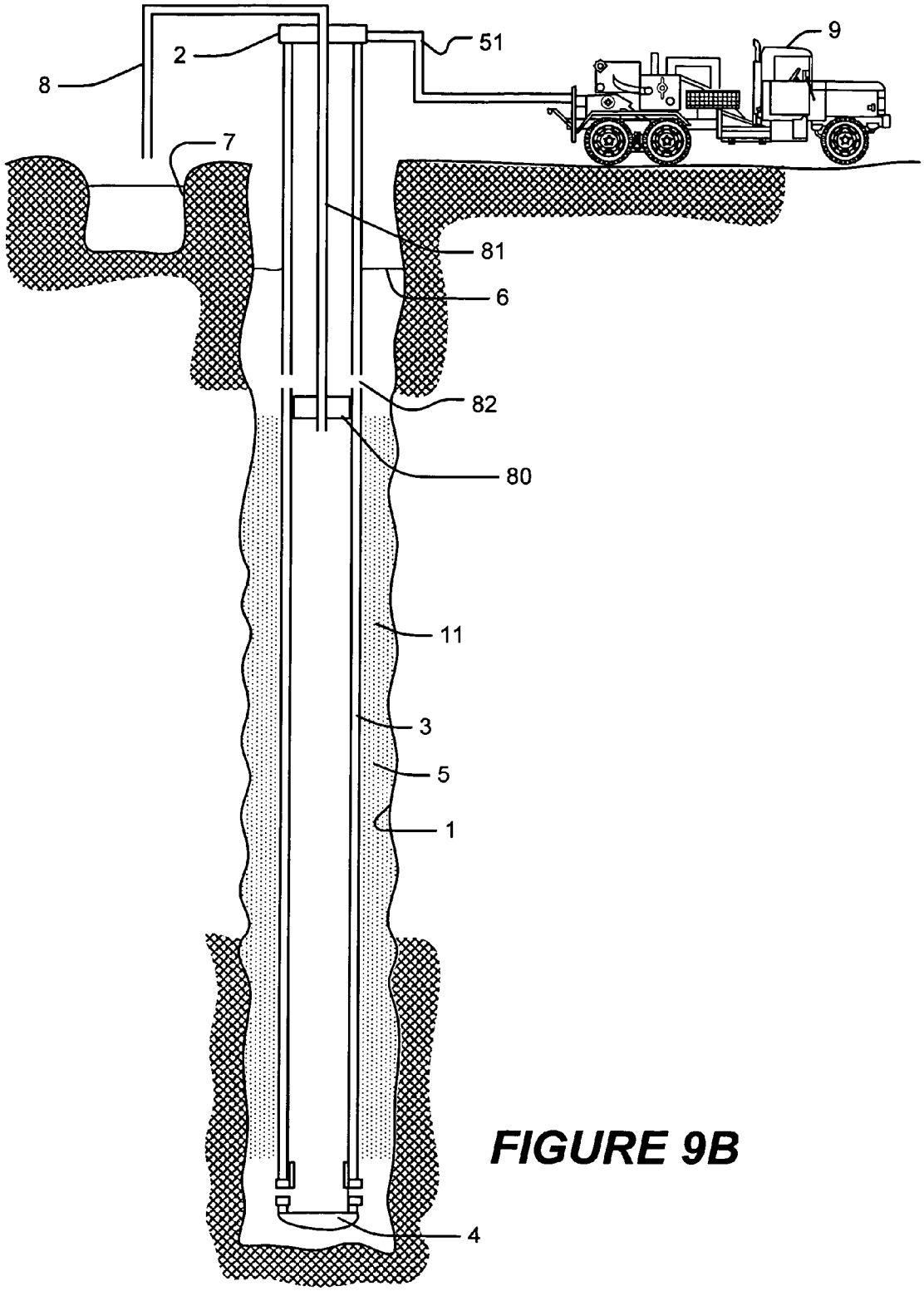
FIG. 9B is a cross-sectional, side view of the well bore and casing illustrated in FIG. 9A, wherein a cement composition is pumped into the annulus below the cross-over tool.

Referring to FIG. 9B, a cross-sectional, side view of the well bore of FIG. 9A is again illustrated. In this figure, a cement composition 11 has been pumped from the truck 9, through the hose 51, through the casing ID coupler 2, down through the ID of the casing above the cross-over tool 80, out through ports 82 into the annulus 5, and down toward the casing shoe 4. When the cement composition 11 begins to into the ID of the casing 3 at the casing ID coupler, it is likely that circulation fluid may flow out of the annulus at the mouth of the well bore rather than through the return line 8. Thus, during the initial stages of the process, circulation fluid may need to be pumped out of the annulus as the mouth of the well bore. However, after a significant amount of cement composition 11 has entered the annulus 5 through the ports 82, the weight of the cement composition will push downwardly on the circulation fluid in the annulus to initiate fluid flow in a reverse circulation direction through the casing shoe 4. From this point forward, returns may be taken from the ID of the casing 3 through the ID line 81.

Any number of commercially available cross-over tools may be used with the present invention. For example, cross-over tools manufactured by Weatherford International are suitable.

In an alternative embodiment of the invention similar to the embodiment illustrated in FIGS. 9A and 9B, a casing ID coupler 2 is attached to the exposed end of the casing 3. However, rather than using a cross-over tool and ports in the casing to inject the cement composition in the annulus 5, the hose 51 is simply inserted a good distance into the annulus 5 from the mouth of the well bore. Because a certain amount of cement composition is needed to initiate fluid flow in the reverse circulation direction, the end of the hose is inserted to a sufficient depth to allow enough cement composition to be pumped into the annulus without the cement composition spilling out of the mouth of the well bore. As before, when the cement composition is first pumped into the annulus, returns will likely need to be taken directly from the annulus at the mouth of the well bore. However, after enough cement composition has been pumped into the annulus, fluid flow in the reverse circulation direction will be initiated and returns may be taken through the casing ID coupler.

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A method for cementing a casing in an open well bore having no surface casing, wherein an annulus is defined between the casing and the well bore, the method comprising:

sealing the annulus at the mouth of the well bore with a seal comprising an annular plug;

positioning the annular plug around the casing in the annulus at the mouth of the well bore;

attaching an anchor to the casing above the annular plug;

pushing the annular plug downwardly away from the anchor;

pumping a cement composition into the annulus through the seal; and taking circulation fluid returns from the inner diameter of the casing.

2. The method of claim 1, wherein said positioning the annular plug comprises placing a unitary annular plug over an exposed end of the casing.

3. The method of claim 1, wherein said positioning the annular plug comprises placing a plurality of plug segments around the casing in the annulus at the mouth of the well bore.

4. The method of claim 1, wherein said positioning the annular plug comprises inserting slips between the casing and the annular plug, and wherein said pushing comprises pushing the slips downwardly.

5. The method of claim 1, wherein said pumping a cement composition into the annulus through the seal comprises pumping through a conduit that extends through the annular plug.

6. The method of claim 1, wherein said taking circulation fluid returns from the inner diameter of the casing comprises attaching a coupler to an exposed end of the casing and connecting a flow line to the coupler, wherein the flow line fluidly communicates with the inner diameter of the casing through the coupler.

7. A method of sealing a well bore annulus at the mouth of an open well bore having a casing extending there from and no surface casing, the method comprising:

positioning an annular plug around the casing in the annulus below and proximate the mouth of the well bore, wherein the annular plug has conduit through the annular plug allowing fluid communication with the annulus below the annular plug;

attaching an anchor to the casing above the annular plug; and pushing the annular plug downwardly away from the anchor.

8. The method of claim 7, wherein said positioning the annular plug comprises placing a unitary annular plug over an exposed end of the casing.

9. The method of claim 7, wherein said positioning the annular plug comprises placing a plurality of plug segments around the casing in the annulus at the mouth of the well bore.

10. The method of claim 7, wherein said positioning the annular plug comprises inserting slips between the casing and the annular plug, and wherein said pushing comprises pushing the slips downwardly.

11. A method for cementing a casing in an open well bore having no surface casing, wherein an annulus is defined between the casing and the well bore, the method comprising:

injecting a cement composition into the annulus at a level below the mouth of the well bore a sufficient distance to prevent the cement composition from flowing out the top of the annulus, whereby the weight of the cement composition in the annulus initiates fluid flow in the well bore in a reverse circulation direction before the cement composition flows out the top of the annulus; and taking circulation fluid returns from the inner diameter of the casing.

12. The method for cementing a casing as claimed in claim 11, wherein said injecting a cement composition into the annulus comprises:

placing a cross-over tool in the inner diameter of the casing;

forming ports in the casing at a location above the cross-over tool; and pumping cement composition through the inner diameter of the casing and out through the ports in the casing into the annulus.

13. The method for cement a casing as claimed in claim 11, wherein said taking circulation fluid returns from the inner diameter of the casing comprises: placing a flow line in the well bore that fluidly communicates with the inner diameter of the casing below the cross-over tool; and drawing circulation fluid from the casing inner diameter through the flow line.

14. The method of claim 11, wherein said injecting a cement composition into the annulus comprises:

inserting a conduit into the annulus to a level below the mouth of the well bore a sufficient distance to prevent the cement composition from flowing out the top of the annulus; and pumping cement composition through the conduit into the annulus.

15. The method of claim 11, wherein said taking circulation fluid returns from the inner diameter of the casing comprises attaching a coupler to an exposed end of the casing and connecting a flow line to the coupler, wherein the flow line fluidly communicates with the inner diameter of the casing through the coupler.

16. A system for cementing a casing in an open well bore having no surface casing, wherein an annulus is defined between the casing and the well bore, the system comprising:

a seal of the annulus at the mouth of the well bore, wherein said seal comprises an annular plug around the casing at the mouth of the well bore;

an anchor attached to the casing above the annular plug; and at least one jack positioned between the anchor and the annular plug, wherein the at least one jack pushes the annular plug downwardly away from the anchor;

a cement composition pump fluidly connected to the annulus through the seal; and a coupling connected to the exposed end of the casing for taking circulation fluid returns from the inner diameter of the casing.

17. The system of claim 16, wherein said annular plug comprises a unitary annular plug.

18. The system of claim 16, wherein said annular plug comprises a plurality of plug segments that together form the annular plug.

19. The system of claim 16, further comprising slips positioned between the casing and the annular plug, and wherein the at least one jack is positioned between the anchor and the slips, wherein the at least one jack pushes the slips downwardly away from the anchor.

20. The system of claim 16, further comprising a conduit that extends through the annular plug.

21. The system of claim 16, further comprising a coupler attached to an exposed end of the casing and connect to a flow line, wherein the flow line fluidly communicates with the inner diameter of the casing through the coupler.

22. A seal of a well bore annulus at the mouth of an open well bore having a casing extending there from and no surface casing, the seal comprising:

an annular plug around the casing in the annulus below and proximate the mouth of the well bore, wherein the annular plug has conduit through the annular plug allowing fluid communication with the annulus below the annular plug;

an anchor attachable to the casing above the annular plug; and at least one jack positioned between the annular plug and the anchor, wherein the at least one jack pushes the annular plug downwardly away from the anchor.

23. The seal of claim 22, wherein said annular plug comprises a unitary annular plug.

24. The seal of claim 22, wherein said annular plug comprises a plurality of plug segments that collectively form the annular plug.

25. The seal of claim 22, further comprising slips inserted between the casing and the annular plug, and wherein said at least one jack pushes the slips downwardly.

26. A system for cementing a casing in an open well bore having no surface casing, wherein an annulus is defined between the casing and the well bore, the system comprising:

a cement composition pump;

a cement composition injector fluidly connected to the cement composition pump, wherein the injector is positioned at a level below the mouth of the well bore a sufficient distance to prevent the cement composition from flowing out the top of the annulus, whereby the weight of the cement composition in the annulus initiates fluid flow in the well bore in a reverse circulation direction before the cement composition flows out the top of the annulus; and a coupler attached to an exposed end of the casing for taking circulation fluid returns from the inner diameter of the casing.

27. The system for cementing a casing as claimed in claim 26, further comprising:

a cross-over tool positioned in the inner diameter of the casing;

at least one port in the casing at a location above the cross-over tool; and a flow line in the well bore that fluidly communicates with the inner diameter of the casing below the cross-over tool, wherein said injector comprises a conduit between the pump and the inner diameter of the casing above the cross-over tool.

28. The system of claim 26, wherein said injector comprises:

a conduit inserted into the annulus to a level below the mouth of the well bore a sufficient distance to prevent the cement composition from flowing out the top of the annulus.

29. The system of claim 26, wherein said coupler for taking circulation fluid returns from the inner diameter of the casing is connected to a flow line, wherein the flow line fluidly communicates with the inner diameter of the casing through the coupler.

* * * * *